US008144245B2

(12) United States Patent
Vik

(10) Patent No.: US 8,144,245 B2
(45) Date of Patent: Mar. 27, 2012

(54) METHOD OF DETERMINING A MACHINE OPERATION USING VIRTUAL IMAGING

(75) Inventor: Timothy Allen Vik, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 1397 days.

(21) Appl. No.: 11/711,626

(22) Filed: Feb. 28, 2007

(65) Prior Publication Data

US 2008/0208415 A1 Aug. 28, 2008

(51) Int. Cl.
*H04N 7/12* (2006.01)

(52) U.S. Cl. ..... 348/424.1; 348/425.2; 348/424.2

(58) Field of Classification Search ..... 348/424.1, 348/421.2, 425.2

See application file for complete search history.

(56) References Cited

U.S. PATENT DOCUMENTS

| | | | | |
|---|---|---|---|---|
| 5,646,844 | A | 7/1997 | Gudat et al. | |
| 5,850,341 | A | 12/1998 | Fournier et al. | |
| 6,076,030 | A * | 6/2000 | Rowe | 701/50 |
| 6,108,949 | A | 8/2000 | Singh et al. | |
| 6,167,336 | A | 12/2000 | Singh et al. | |
| 6,363,632 | B1 | 4/2002 | Stentz et al. | |
| 6,389,360 | B1 | 5/2002 | Alft et al. | |
| 6,751,540 | B2 | 6/2004 | Keefer et al. | |
| 6,988,591 | B2 | 1/2006 | Uranaka et al. | |
| 6,996,507 | B1 | 2/2006 | Myr | |
| 7,357,196 | B2 * | 4/2008 | Goldman et al. | 175/24 |
| 2003/0120472 | A1 | 6/2003 | Lind | |
| 2004/0073468 | A1 | 4/2004 | Vyas et al. | |
| 2005/0158129 | A1 * | 7/2005 | Chi et al. | 405/271 |
| 2005/0284661 | A1 * | 12/2005 | Goldman et al. | 175/39 |

FOREIGN PATENT DOCUMENTS

EP 1 262 915 A2 12/2002

OTHER PUBLICATIONS http://www.i3.com/index.html, i-cubed: We Map the World, pp. 1-2, Feb. 23, 2007.

http://wwwi3.com/products_terrain.html, i-cubed: Terrain, p. 1, Feb. 23, 2007.

http://www.i3.com/about_vissim.html, i-cubed: Vis Sim, pp. 1-3, Jan. 25, 2007.

* cited by examiner

*Primary Examiner* — Djenane Bayard

(74) *Attorney, Agent, or Firm* — Finnegan, Henderson, Farabow, Garrett & Dunner LLP

(57) ABSTRACT

A method of determining a machine for operating at an actual site includes establishing a three-dimensional geographical model representing the actual site, determining at least one operation characteristic relating to the operation of each of a set of machines in relation to the model, and predicting at least one performance characteristic for each machine based on the at least one operation characteristic and at least one respective characteristic of the different machines. The method further includes comparing the predicted performance characteristics for the different machines, and determining a target machine based on the comparison.

27 Claims, 5 Drawing Sheets

METHOD OF DETERMINING A MACHINE OPERATION USING VIRTUAL IMAGING

TECHNICAL FIELD

The present disclosure relates generally to a method of determining operation characteristics, and more particularly, to a method of determining operation characteristics using virtual imaging.

BACKGROUND

Mining and large scale excavating operations may require fleets of haulage vehicles to transport excavated material, such as ore or overburden, from an area of excavation to a destination. For such an operation to be productive and profitable, the fleet of haulage vehicles must be efficiently operated. Efficient operation of a fleet of haulage vehicles is affected by numerous operation characteristics. For example, the grade and character of haul routes and the amount of payload have direct effects on haulage cycle time, equipment component wear, and fuel consumption which, in turn, directly affect productivity and profitability of the operation.

Computer-aided design (CAD) and visualization tools may be used to design, develop, and manufacture the haulage vehicles. Visualization tools have also been used to display products offered by a business. However, the information provided by such tools may be restricted to textual information and limited image data, such as a two-dimensional map of a work site or a two-dimensional image of a product.

One visualization tool is described in U.S. Pat. No. 6,108,949 (the '949 patent) issued to Singh et al. The '949 patent describes a planning tool for determining an excavation strategy for a mine site. The planning tool uses the geometry of a site to determine an optimum excavation operation for a particular machine. The planning tool allows the user to select where to excavate and an orientation of an excavating tool of the machine. The optimum excavation operation may be determined based on a predicted excavation result, such as a volume of material excavated, energy expended, and time.

Although the system of the '949 patent may provide a tool for visualizing the operation of a machine, the information provided by the tool is limited. For example, the visualization tool of the '949 patent is based on the operation of a single machine and compares excavation operations of that one machine. However, in reality, many different types of machines can be used during an excavation operation, and each type of machine may be available in different models and configurations. In addition, the visualization tool only incorporates elevation information of the work site, thereby including a limited amount of information describing the work site and limiting the ability of the tool to provide an accurate prediction of the excavation result.

Furthermore, the visualization tool is used to make decisions about the excavation operation in real-time and not for more comprehensive long-term site solution planning. For example, the visualization tool does not allow adjusting the number of machines at the work site. Therefore, the user of the visualization tool cannot effectively optimize the efficiency of the excavation operation. Also, the visualization tool is limited to visualizing the operations of the machine within the boundaries of the material to be excavated or the operational limits of the machine. Therefore, the visualization tool is limited to a single work site, and the user cannot compare the characteristics of more than one work site to make a proper determination of where to excavate.

The disclosed method is directed to overcoming one or more of the problems set forth above.

SUMMARY OF THE INVENTION

In one aspect, the present disclosure is directed to a method of determining a machine for operating at an actual site. The method includes establishing a three-dimensional geographical model representing the actual site, determining at least one operation characteristic relating to the operation of each of a set of machines in relation to the model, and predicting at least one performance characteristic for each machine based on the at least one operation characteristic and at least one respective characteristic of each machine. The method also includes comparing the predicted performance characteristics for each machine, and determining a target machine based on the comparison.

In another aspect, the present disclosure is directed to a system for managing a machine at a site. The system includes a controller, and the controller includes a user interface configured to display a three-dimensional geographical model representing a plurality of remote sites. The controller is configured to receive input identifying one of the remote sites, determine an operation of the machine in relation to the model at the selected site, determine at least one operation characteristic relating to the operation of the machine, and predict at least one performance characteristic of the machine based on the at least one operation characteristic and at least one characteristic of the machine.

In yet another aspect, the present disclosure is directed to a method of planning an operation of a machine at an actual site. The method includes establishing a three-dimensional geographical model representing the actual site, determining a sales price for at least one material located at the actual site, determining the machine, and determining at least one operation characteristic relating to the operation of the machine in relation to the model. The at least one operation characteristic includes an amount of material excavated. The method also includes predicting at least one performance characteristic for the machine based on the at least one operation characteristic and at least one characteristic of the machine. The at least one performance characteristic includes an estimated profit associated with the machine.

DETAILED DESCRIPTION

Reference will now be made in detail to the present exemplary embodiments of the invention, examples of which are illustrated in the accompanying drawings. Wherever possible, the same reference numbers will be used throughout the drawings to refer to the same or like parts.

Figure 1:
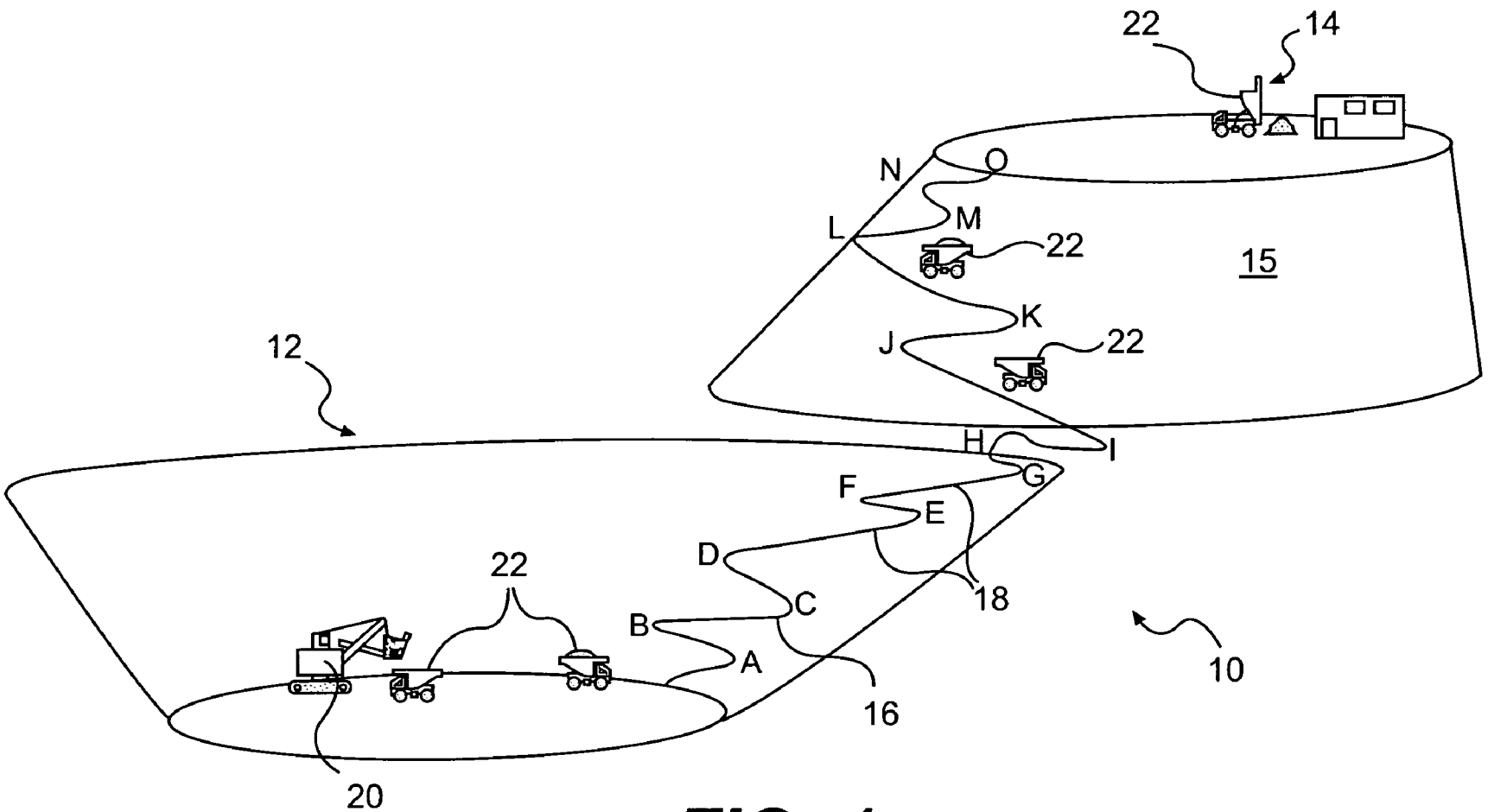
FIG. 1 is a schematic and diagrammatic representation of an exemplary mine layout.

FIG. 1 schematically and diagrammatically illustrates a work site 10, such as an open pit mine operation. The open pit mine operation 10 includes an open pit mine 12 and a processing region 14, which may be, but is not required to be, on top of a dumping mound 15. The open pit mine 12 is connected to the processing region 14 by at least one haul route 16, which includes haul route segments 18 between designated letters A, B, C, etc. A fleet of machines 20, such as haulage vehicles 22 and/or other types of machines, may travel from the area of excavation of the open pit mine 12 along the haul route 16 to the processing region 14. In the open pit mine 12, another machine 20, such as an excavator, may operate to excavate material, which may be ore or overburden and which may be loaded into the haulage vehicles 22. The haulage vehicles 22 may carry a payload, e.g., the excavated material, when traveling from the open pit mine 12 to the processing region 14. Thus, in an exemplary haulage cycle, a payload may be loaded onto the haulage vehicle 22, the haulage vehicle 22 may travel along its assigned haul route 16 from the mine 12 to the processing region 14, where the payload may be unloaded from the haulage vehicle 22, and then the haulage vehicle 22 may travel along its assigned haul route 16 back to the mine 12 from the processing region 14. Each haulage vehicle 22 may be assigned to a specific haul route 16 for a particular day, week, or other period of time, or until a particular haulage operation is completed.

The machine 20 may be a large, off-road vehicle. It should be noted that the disclosed embodiment may be applicable to other types of machines such as, for example, on-highway trucks or other earth moving machinery capable of carrying a payload. The disclosed embodiment may also be applicable to a fixed or mobile machine that performs some type of operation associated with an industry such as mining, construction, farming, transportation, power generation, tree harvesting, forestry, or any other industry known in the art. For example, the machine 20 may be a truck, crane, earth moving machine, mining vehicle, material handling equipment, farming equipment, marine vessel, aircraft, an excavator, a dozer, a loader, a backhoe, a motor grader, a dump truck, a turbine, a power production system, an engine system operating in a plant or an off-shore environment, a feller, a harvesting machine, a skidder, a forwarder, a drag line system, or any type of machine that operates in a work environment such as a construction site, mine site, power plant, tree harvesting site, etc.

The work site 10 may include a single or a plurality of locations where the machine 20 operates. The point of excavation within the mine 12 and the processing region 14 may be at different elevations. As a result, the haulage vehicles 22 may transport excavated material along the haul route 16 at least in part from a lower elevation to a higher elevation. The haul route 16 may be designed with such a grade as to permit the haulage vehicles 22 to negotiate the portion of a haulage cycle from the excavation area within the mine 12 to the processing region 14 while carrying a payload at or near the maximum rated payload for the haulage vehicle 22. Alternatively, the haul route 16 may vary significantly from the ideal, and the weight of one payload may likewise vary substantially from the weight of another payload.

Figure 2:
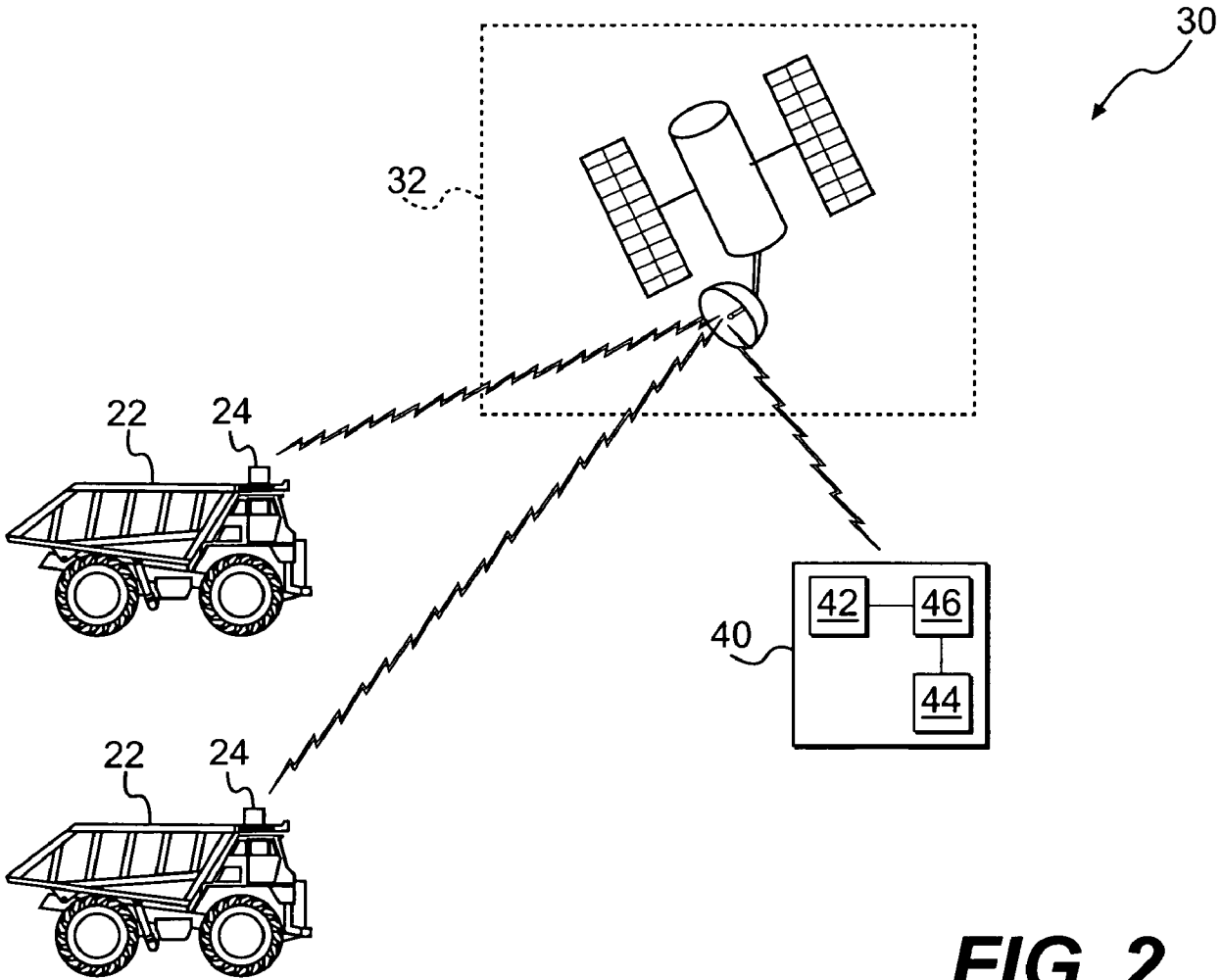
FIG. 2 is a schematic and diagrammatic illustration of an exemplary communication system.

FIG. 2 illustrates an embodiment of a communication system 30. The communication system 30 may include a plurality of communicating devices 24, each associated with one of the machines 20, e.g., the haulage vehicles 22 or other machines. The communicating device 24 may be electronically connected, e.g., via an equipment interface (not shown), to other components of the machine 20 in order to receive power from the components, and/or to transfer component/operation related information to and from the components, such as a controller (not shown). Alternatively, the communicating device 24 may include its own power source. The communicating device 24 may also include a position determining system (not shown), which may include a global positioning satellite (GPS) receiver and associated hardware and software, for receiving and determining information relating to the location of the machine 20, portions of the machine 20, or elements associated with the machine operation. Alternatively, the position determining system may be located elsewhere on the machine 20, and the machine location information may be delivered to the communicating device 24.

The communicating device 24 may communicate information to a remote data facility, such as an off-board central computer system 40, and may receive information and/or request information from the central computer system 40. The communicating devices 24 of a fleet of machines 20 may be configured to communicate with the central computer system 40, and/or each other through a communication network 32. The communication network 32 may include a wireless network, wired network, or a combination thereof. The wireless network may include a satellite network, a cellular network, a radio frequency network, and/or other forms of wireless communication. In addition, the communication network 32 may include wired network such as a network with a modem with access to a public, or private, telephone line, a fiber optic or coaxial cable based network, a twisted pair telephone line network, or any other type of wired communication network.

The controller of the communicating device 24 may be configured to receive messages from the central computer system 40, position information from the positioning system, time information from a real time clock, equipment information from the equipment interface, and responsively monitor the position, time, and/or operation of the machine 20, and deliver the monitoring information to the central computer system 40. The controller may also include memory for storing information, e.g., information relating to the machine operation or the environment, when appropriate.

The central computer system 40 may include, for example, a machine simulator, a mainframe, a work station, a laptop, a personal digital assistant, and other computer systems known in the art. The central computer system 40 may include a number of conventional devices including a microprocessor, a timer, input/output devices (e.g., a graphical user interface 42), a memory device, and a communicating device 44. For example, the central computer system 40 may include a controller 46 that is programmed and configured for receiving and processing information from each of the machines 20 and also for transmitting information to each of the machines 20 via the communicating device 44. The controller 46 may include any means for monitoring, recording, storing, indexing, processing, and/or communicating the real-time data concerning operational aspects of the machine 20. These means may include components such as, for example, a memory, one or more data storage devices, a central processing unit, or any other components that may be used to run an application.

The central computer system 40 may be located proximate the work site 10 or at a distance remote from the work site 10. The central computer system 40 may be located in a remote station, a monitoring facility, a central data facility, or other facility capable of exchanging information with at least one machine communicating device 24. For example, the central computer system 40 may be located in a fixed or mobile office capable of communicating and processing equipment/process information, or capable of passing the information to another facility to perform this analysis.

The user interface 42 may provide one or more input, processing, and/or output devices, such as one or more receiving, computing, and/or display systems for use by a business entity associated with the machine 20, such as a manufacturer, dealer, retailer, owner, service provider, client, operator, service contractor, repair technician, or any other entity that generates, maintains, sends, and/or receives information associated with the machine 20. For example, the user interface 42 may include one or more monitors (e.g., a liquid crystal display (LCD), a cathode ray tube (CRT), a personal digital assistant (PDA), a plasma display, a touch-screen, a portable hand-held device, or any such display device known in the art) configured to actively and responsively display information relating to the machine 20.

Figure 3:
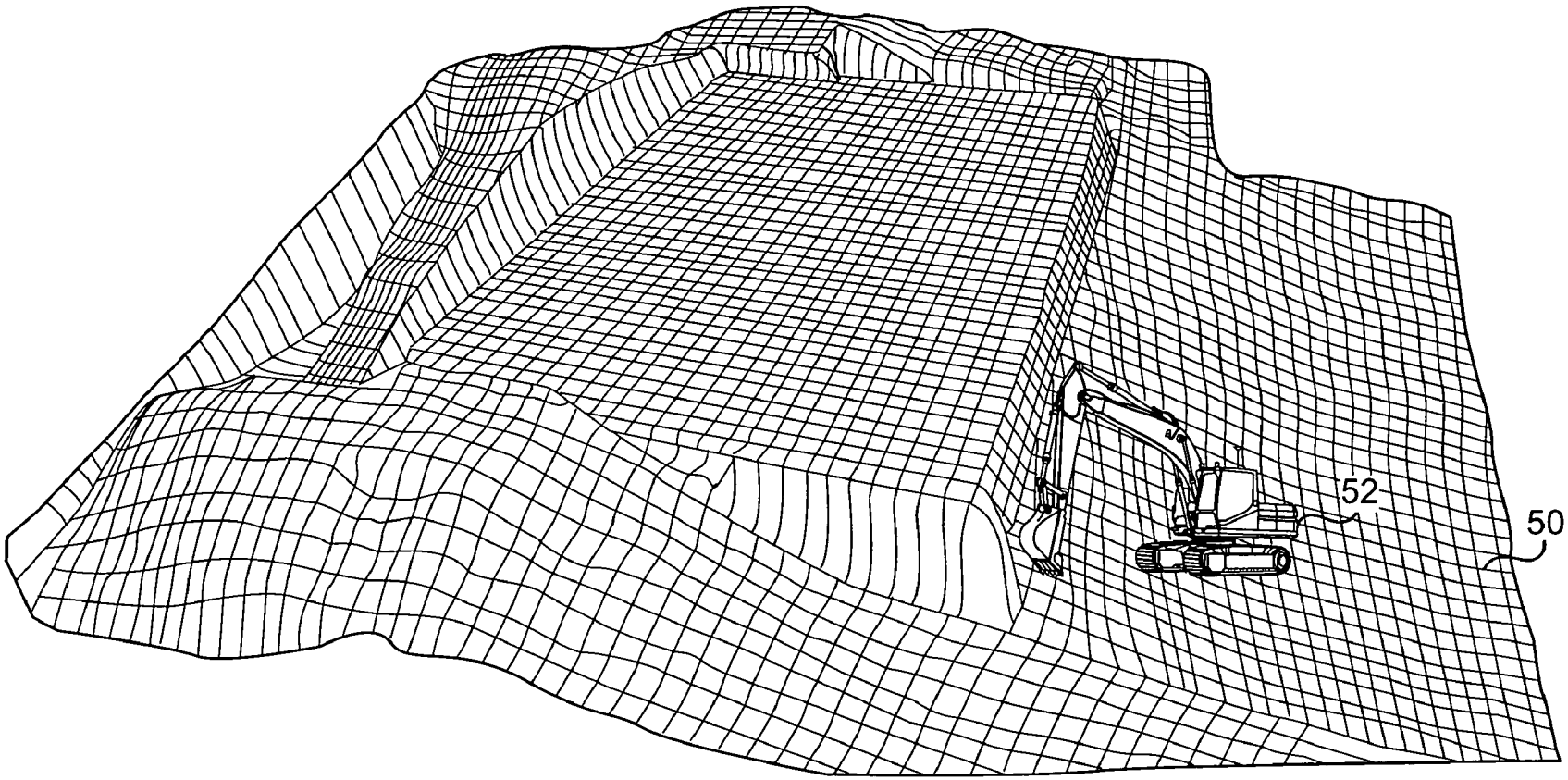
FIG. 3 is an illustration of an exemplary disclosed graphical user interface for use with the communication system of FIG. 2.

As shown in FIG. 3, the user interface 42 may display a terrain map 50 of one or more work sites, such as mine sites (e.g., the work site 10), road construction sites, subdivision sites, and other sites where operations are to be performed. Each of the work sites may be separated by varying distances. Although FIG. 3 shows a three-dimensional (3-D) virtual representation of the geography of a single work site, the terrain map 50 may also include 3-D virtual representations of the geography of one or more other work sites. Thus, the terrain map 50 may include geographical characteristics associated with a plurality of actual work sites that are located adjacent to or remotely from each other. When the terrain map 50 represents an actual work site, the information provided by the terrain map 50 may include geographical characteristics measured from the actual work site and stored in the terrain map 50. The geographical characteristics may be received by the central computer system 40 in real-time using one or more monitoring or sensing devices provided on the machines 20 as described above. Alternatively, the terrain map 50 may also include virtual work sites that are not modeled after the actual work sites 10.

The 3-D virtual environment may represent the earth's surface. For example, geographical characteristics included in the terrain map 50 may include work surface information defining ground elevation, ground contour, earthen material composition (e.g., vegetation, minerals, water, etc.), temperature, and/or consistency at a plurality of locations. Additionally, the geographical characteristics included in the terrain map 50 may include the location, size, shape, composition, and/or consistency of above- or below-ground obstacles, such as, for example, roads, utility lines, storage tanks, buildings, property boundaries, trees, bodies of water, and/or other obstacles. The location, species, size, age, and/or other characteristics may be determined for each tree and included in the terrain map 50. Thus, one or more trees may be monitored periodically to determine various types of information relating to one or more harvesting operations. In one aspect, the geographical characteristics may be measured using geographic sensing equipment (not shown), such as, for example, a ground-penetrating radar systems (GPR), GPS systems, and/or satellite imagery equipment known in the art. The geographical characteristics included in the terrain map 50 may also reflect predicted weather conditions and/or current market conditions, such as commodity prices for each material capable of being excavated from the terrain.

The user interface 42 may also display one or more machines 52 located on the terrain map 50. The machines 52 may include the actual machines 20 located at the actual work site 10 represented by the terrain map 50 and/or one or more virtual machines. The virtual machines may not represent actual machines 20 located at the actual work site 10, but may be selected and configured by the user to predict and simulate the performance of such machines as if they were operating at the work site represented on the terrain map 50. The virtual machines may include, for example, commercially-available machines or other existing machines, machines that are custom-designed by the user using one or more existing components and/or machines or components and/or machines being developed, etc. The user interface 42 may also allow the user to select or input one or more machine characteristics of the virtual machines. Alternatively, the machine characteristics may be automatically determined from a database connected to the user interface 42 that includes performance information relating to different types of models of machines, different types of models of machine components, estimates based on existing models of machines or machine components, etc. For example, the machine characteristics may include weight, size, capacity, speed and/or other performance data, etc. The performance data or other machine characteristics may be determined experimentally.

The user interface 42, including the terrain map 50, may be stored within a memory, one or more data storage devices, and/or a central processing unit of the controller 46 and communicated to the user interface 42. Alternatively, the terrain map 50 may be stored within a memory, one or more data storage devices, and/or a controller of the user interface 42. In another aspect, the terrain map 50 may be stored in a separate location and communicated to the user interface 42. Further, the controller 42 may update the terrain map 50 based on received real-time data to reflect changes affected upon the work site 10 as a result of a change in machine position during travel, and/or tool movement and loading sensed during excavation operations.

The user interface 42 may be used to input or select one or more operation characteristics associated with one or more of the displayed machines 52. The operation characteristics may be input or selected by the user for each machine 52. The operation characteristics may include characteristics associated with a particular machine operation assigned to the machine 52, e.g., work assignment information (e.g., assigned haul route, location of machine operation, etc.), control parameters (e.g., measured and/or target payload amount, composition of payload, gear selection along the haul route, vehicle speed along the haul route, etc.), etc. For example, the user may use the terrain map 50 to specify the operation for the displayed machine 52, e.g., by indicating on the terrain map 50 a location to load a payload, a haul route to be traveled, a location to unload the payload, a location to excavate, or any other action and its location. In addition, the displayed machines 52 may be assigned to travel between different work sites and are not limited to traveling around a single work site on the terrain map 50.

Based on one or more of the geographical, machine, and operation characteristics relating to the specific machine 52 or machine operation, the user interface 42 may calculate and display one or more performance characteristics associated with one or more of the displayed machines 52. The performance characteristics may relate to timeframe, cost, health monitoring, maintenance, scheduling, efficiency, output, etc., for a specific work site, operation, machine, etc. and at various times during the operation. For example, the user interface 42 may indicate an estimated time and cost for completion of the operation, a machine ground speed (e.g., the ground speed of the machine), an engine speed (e.g., the rotational speed (RPM) of the engine), a fuel level of the machine, a transmission output ratio (e.g., a gear of transmission of the machine), slip (e.g., a. rate at which the traction device of the machine may be slipping), roll and pitch (e.g., the inclination angles of the machine with respect to horizontal ground), steering command (e.g., a steering angle of the traction device of the machine), and/or load (e.g., a capacity to which a tool of the machine is filled). Alternatively or additionally, the user interface 42 may indicate latitude and longitude, and/or other coordinates representing a position of the machine with respect to the work site at various times during the operation. Alternatively or additionally, the user interface 42 may indicate estimated profit, such as, for example, estimated total sales price (e.g., based on commodity price or other indicator of current market conditions per weight of material excavated) minus operation costs (e.g., estimated cost of operating the machine per weight of material excavated). The total sales price and the operation costs may be estimated based on an estimated weight of total material excavated. Furthermore, the operation costs may vary depending on the type of machine 52 selected for the operation. Alternatively or additionally, the user interface 42 may indicate when to perform a harvesting operation, such as when to cut one or more trees (e.g., depending on the species, growth cycle of the trees, availability of machines (e.g., forwarders, fellers, etc.), etc.), the location of trees to be cut, a route for the selected machine 52 to travel, desired drainage systems for the trees, a delivery time for the cut trees, etc.

Figure 4:
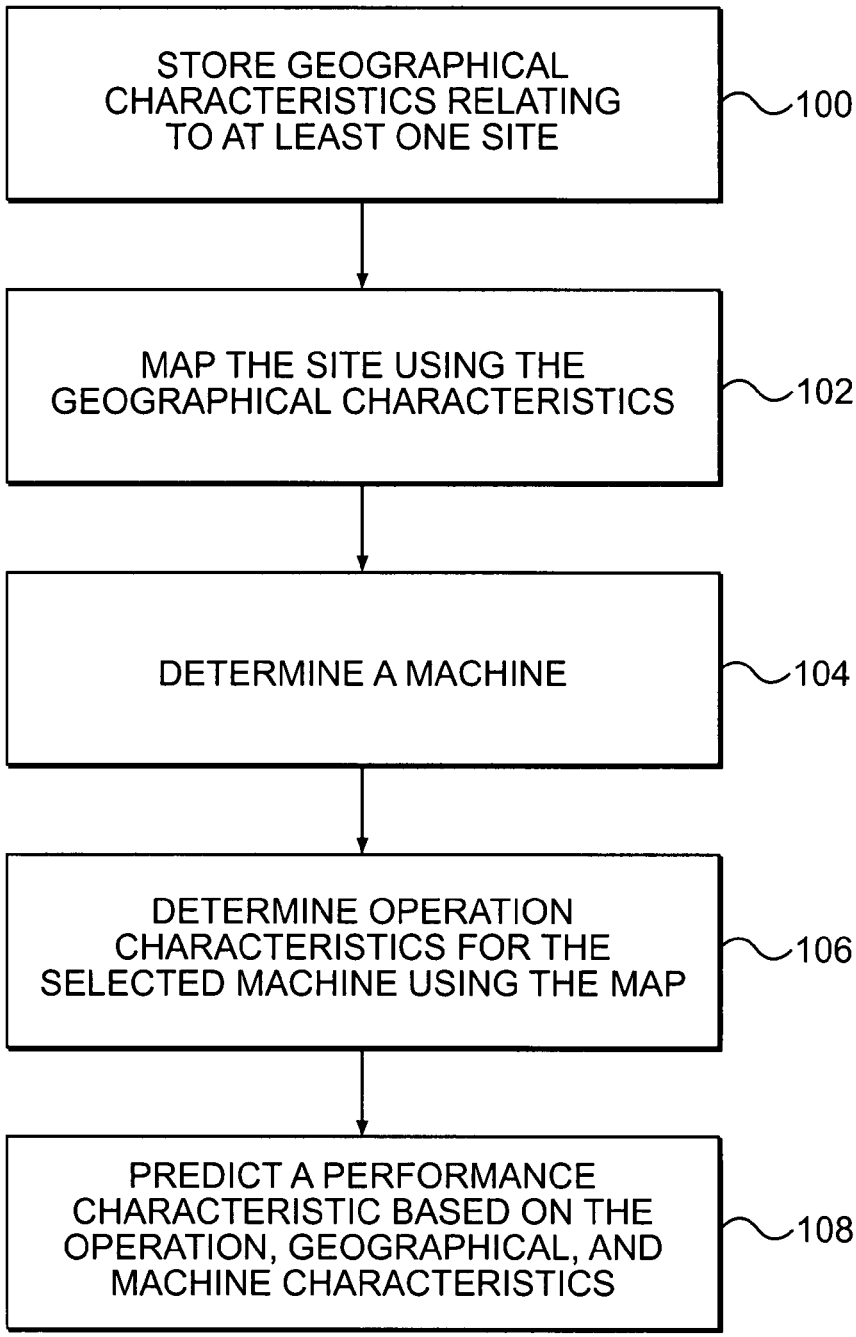
FIG. 4 is a flow chart illustrating an exemplary method of controlling the haulage vehicle.

FIG. 4 is a flow chart of an exemplary process for managing the machine 20 consistent with certain disclosed embodiments. Specifically, the exemplary process may be used to predict the performance of one or more machines 20 at one or more work sites 10. In one embodiment, the process of FIG. 4 may be executed by the central computer system 40 before the machine 20 has been delivered to the work site 10 and/or after delivery of the machine 20 to the work site 10.

One or more surveying or monitoring entities (not shown) may be used to gather and store information relating to the geographical characteristics of the work sites 10 (step 100). The measured geographical characteristics may be transmitted to the central computer system 40, and the central computer system 40 may generate one or more terrain maps 50 based on the transmitted information for the work sites 10 (step 102). Alternatively, or in addition, the surveying or monitoring entity may generate the terrain map 50 based on the measured information and may transmit the map 50 to the central computer system 40, or the surveying or monitoring entity may transfer the measured information to a mapping entity (not shown) that may generate the terrain map 50 based on the transmitted information and transmit the map 50 to the central computer system 40.

The user of the central computer system 40 may input or select, via the user interface 42, the displayed machine 52 whose performance is to be predicted (step 104). Alternatively, the user may select from actual machines 20 located within a predetermined distance from the actual work sites 10 represented on the terrain map 50. As another alternative, the user may construct the displayed machine 52 virtually by inputting or selecting components for the machine 52. The user may also select or input one or more operation characteristics as described above for the selected machine 52 using the terrain map 50 (step 106).

Then, the user interface 42 may predict one or more performance characteristics as described above for the selected machine 52 (step 108). The performance characteristics may be predicted based on the operation, geographical, and machine characteristics of the associated operation, work site 10, and/or machine 52. The user may use the predicted performance characteristics to plan one or more operations at the selected work site 10. For example, the user may compare one or more of the performance characteristics and may plan an operation using the selected machines 52 by optimizing based on certain performance characteristics. After planning the desired operation using the central computer system 40 as described above, the user may purchase and/or lease the desired number and type of machines, and may distribute work assignments to each of the purchased and/or leased machines. Alternatively, or in addition, the user may also reallocate work assignments to the machines 20 that are already operating at the work sites 10.

Figure 5:
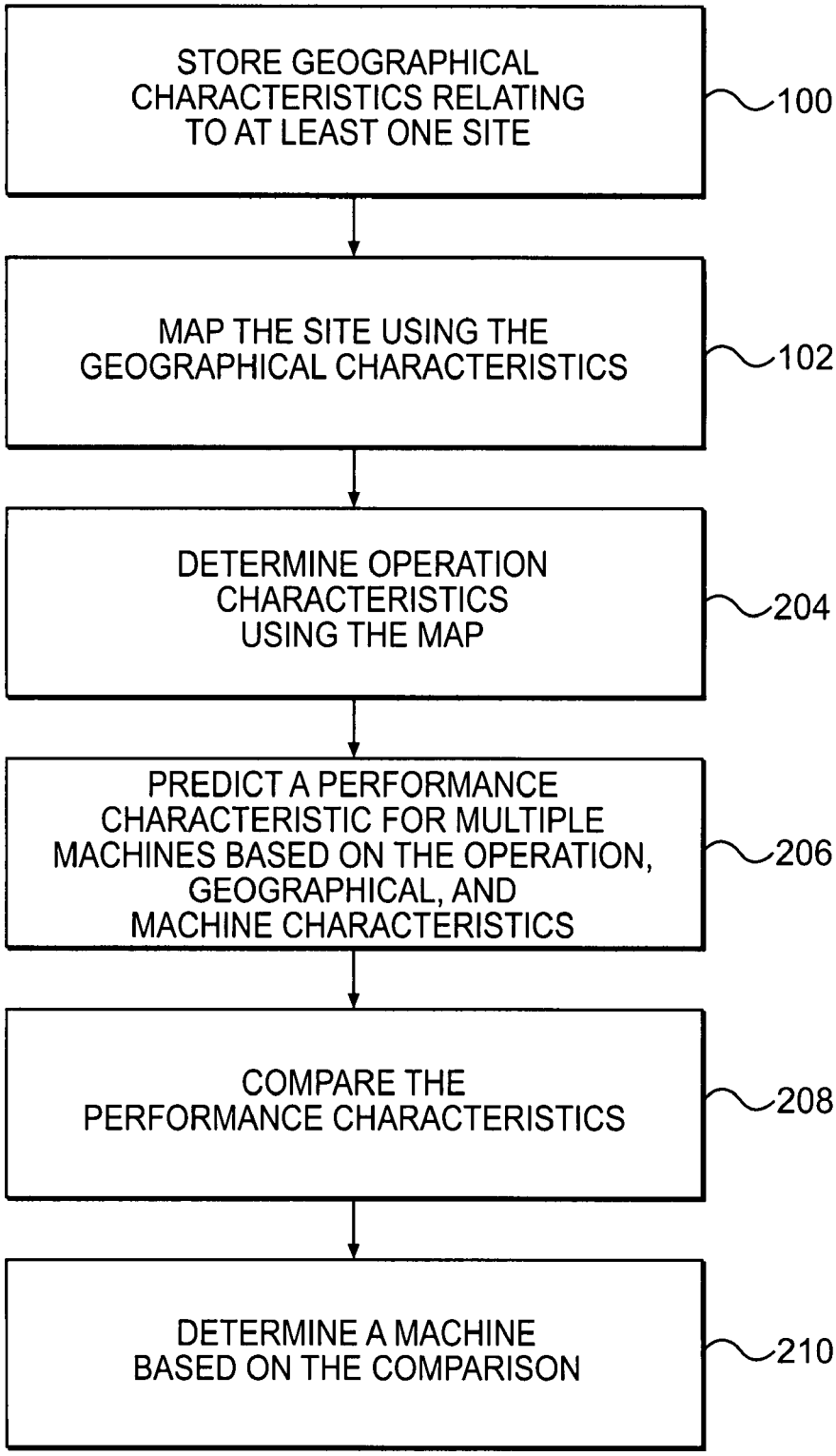
FIG. 5 is a flow chart illustrating another exemplary method of controlling the haulage vehicle.

In another alternative, as shown in FIG. 5, after storing information relating to geographical characteristics of one or more work sites 10 (step 100) and generating one or more terrain maps 50 based on the transmitted information for the work sites 10 (step 102), the user may select or input one or more operation characteristics using the terrain map 50 (step 204). The user then selects a plurality of machines having different configurations, or the central computer system 40 may automatically select the plurality of machines having different configurations.

Then, the user interface 42 may predict one or more performance characteristics for each of the selected machines (step 206). The performance characteristics may be predicted based on the operation, geographical, and machine characteristics of the associated operation, work site 10, and/or machines. The predicted performance characteristics for the different machines may be compared by the user (step 208). Then, the user may select one of the machines based on the comparison (step 210).

Alternatively, the central computer system 40 may compare the predicted performance characteristics and may apply an optimization algorithm for determining a recommended machine 52 from the plurality of machines (step 208). The optimization algorithm may select the recommended machine 52 using guidelines, such as minimizing a number of shifts, minimizing total operation time, minimizing operation cycle time, minimizing fuel consumption, minimizing component wear, minimizing cost per unit weight of payload, maintaining an economically efficient balance between one or more of these guidelines, etc. Then, the central computer system 40 may determine the recommended machine 52 based on the comparison and display the recommendation to the user (step 210).

INDUSTRIAL APPLICABILITY

The disclosed method of determining a machine operation using virtual imaging may be applicable to any fixed or moving machine capable of performing any type of operation. The disclosed method of determining a machine operation using virtual imaging may increase the efficiency of the machine operation. The method of determining a machine operation using virtual imaging will now be explained.

In one exemplary embodiment, satellite photography and GPS information may be collected and used to create the 3-D terrain map 50 (steps 100 and 102). The geographical characteristic information stored may include elevation and contour information about the terrain and also information regarding vegetation or other materials that form the terrain, water flow, drainage systems, temperature, etc. By incorporating this geographical characteristic information into the terrain map 50, more accurate predictions for the performance characteristics may be obtained, and a variety of different types of site solution profiles may be obtained. For example, geographical characteristic information such as elevation and obstacle location information can allow the user to plan routes for the machines 20 to travel between work sites 10, where to perform excavation operations at different work sites 10, etc. In another example, geographical characteristic information such as water flow information may be used to determine the direction where water flows when it rains and can allow the user to plan for such a situation. In yet another example, geographical characteristic information such as material composition information may be used to determine the composition of the terrain and can allow the user to plan, e.g., where to retrieve certain types of materials from the ground or how machines will perform when traveling on the terrain. In a further example, geographical characteristic information such as weather predictions may be used, e.g., to plan for a longer period of time to complete an operation when rain, snow, or other such weather conditions are predicted.

The user interface 42 allows the user to select an existing machine 20 or to customize a new machine using one or more existing components and/or machines, or components and/or machines in development, and then the user interface 42 displays the selected machine 52 (step 104). Alternatively, the user may be able to request a list of machines located within a predetermined distance from a selected location, e.g., other work sites near the work site 10 where the operation is to be performed. Then, the central computer system 40 may determine the predicted performance characteristics (step 108) by taking into account the travel times for relocating the machine to the location of the operation. The central computer system 40 may also determine a route for transporting the machine to the work site 10 from the other work site. As a result, performance data associated with operating the existing components and/or machines or similar components and/or machines may be stored by the central computer system 40 and used to obtain more accurate performance characteristic predictions. Furthermore, the numbers of machines allocated to multiple work sites may be managed effectively, and the efficiency of each mine operation 10 may be increased by taking into account any lag time that may result when machines 20 must travel to and from different work sites 10.

The user interface 42 allows the user to select one or more characteristics of the machine operation (step 106). For example, using the terrain map 50, the user may specify the operation location and work assignment for the displayed machine 52 (e.g., excavate X amount of material Y at location A, travel along path Z, unload payload at location B, etc.). The central computer system 40 may predict a performance characteristic based on stored geographical characteristic information for the work site 10 where the operation is to be performed, operation characteristics of the specified operation, and machine characteristics for the selected machine 52 (step 108). As a result, the user may be able to make better business decisions regarding the number and type of machines to purchase and/or lease for the operation. The user may also be able to better plan how to make use of the machines more effectively and efficiently.

The user may also compare the predicted performance characteristics of various operations at different work sites 10. For example, if the user determines a desired amount of payload, the user interface 42 may allow the user to input different scenarios for obtaining that desired amount of payload (e.g., different types of machines, different locations, different operation characteristics, etc.) into the user interface 42. Then, the user may compare the performance characteristics predicted by the user interface 42 for those scenarios.

In another exemplary embodiment, after the geographical characteristic information is collected and used to create the terrain map 50 (steps 100 and 102), the user interface 42 may allow the user to select one or more characteristics of the machine operation as described above (step 204). Then, the central computer system 40 may predict a performance characteristic for a plurality of different machines based on stored geographical characteristic information for the work site 10 where the operation is to be performed, operation characteristics of the specified operation, and machine characteristics for the machines (step 206). The predicted performance characteristics may be displayed to the user, and the user may compare the predicted performance characteristics to select the desired machine 52 for performing the operation (steps 208 and 210). As a result, the user may specify the operation before determining how many and what type of machines to purchase and/or lease. Furthermore, the user may compare the predicted performance characteristics and may weigh the differences between the predicted performance characteristics before determining which machines to use.

Alternatively, the central computer system 40 may compare the predicted performance characteristics, and based on an optimization algorithm, the central computer system 40 may make a recommendation for the desired machine for performing the operation (steps 208 and 210). The central computer system 40 may allow the user to select the guidelines for the optimization algorithm or may automatically determine the guidelines without user input. As a result, the user may specify which optimization guidelines to use for the central computer system 40 to make its recommendation.

In another exemplary embodiment, the user interface 42 may collect and store geographical characteristic information, such as the current market price for the commodity being excavated, in the terrain map 50 (steps 100 and 102). The user selects the machine to be used and a characteristic(s) of the machine operation, such as the amount and location of material to be excavated (steps 104 and 106). Then, the central computer system 40 predicts a performance characteristic, such as the estimated profits based on the planned operation of the selected machine (step 108). The estimated profits may be the current market price for the total amount of material to be excavated minus the estimated operation costs for the selected machine based on the total operation.

Alternatively, after the current market price for the commodity being excavated is collected and stored in the terrain map 50 (steps 100 and 102), the user interface 42 may allow the user to select a characteristic(s) of the machine operation, such as the amount and location of material to be excavated (step 204). Then, the central computer system 40 may predict a performance characteristic for each of a plurality of different machines, such as the estimated profits based on the planned operation of each of the selected machines (step 206). The estimated profits calculation may also be based on other stored geographical characteristic information for the work site 10 where the operation is to be performed, operation characteristics of the specified operation, and machine characteristics for the different machines. The estimated profits may be displayed to the user, and the user may compare the estimated profits using different machines to select the desired machine 52 for performing the operation (steps 208 and 210). As a result, the user may determine which machine to use for a planned operation depending on current market prices for the commodity to be excavated. The user may compare current market prices (or estimated profits) to determine what type of machine to purchase or lease, such as a larger or smaller machine. The user may be able to plan machine operations more effectively and efficiently by taking into account current market conditions.

In yet another exemplary embodiment, the user interface 42 may collect and store geographic characteristic information relating to one or more trees, such as the species, age, and location of each tree (steps 100 and 102). The user selects the machine to be used and characteristic(s) of the machine operation, such as the location or type (e.g., species, size, etc.)

of trees to be harvested (steps 104 and 106). Then, the central computer system 40 predicts a performance characteristic, such as the optimal time to cut the trees, the location of the trees (if the user has only selected a desired type of tree to be cut), an assigned route, a delivery time, etc., based on the selected machine (step 108).

Alternatively, after the species, age, and location information for each tree is collected and stored in the terrain map 50 (steps 100 and 102), the user interface 42 may allow the user to select a characteristic(s) of the machine operation, such as the location or type (e.g., species, size, etc.) of trees to be harvested (step 204). Then, the central computer system 40 may predict a performance characteristic for each of a plurality of different machines, such as the optimal time to cut the trees, the location of the trees, etc., for each of the selected machines (step 206). The predicted performance characteristic may also be based on other stored geographical characteristic information for the work site 10 where the operation is to be performed, operation characteristics of the specified operation, and machine characteristics for the different machines. The predicted performance characteristic may be displayed to the user, and the user may compare the predicted performance characteristics for the different machines to select the desired machine 52 for performing the operation (steps 208 and 210). As a result, the user may efficiently plan a tree harvesting operation using various geographic characteristic information associated with trees at one or more sites, and may determine an optimal time to cut, optimal locations for cutting trees, and other factors based on the geographic characteristic information.

The user interface 42 providing the terrain map 50 may be used by machine owners to plan machine operations. In addition, the user interface 42 may be provided by machine dealers to allow their customers to plan machine operations before purchasing and/or leasing the machines 20. The information provided by the terrain map 50 may be updated in real-time, and therefore, the terrain map 50 may also be used for real-time health monitoring and maintenance of the machines 20.

It will be apparent to those skilled in the art that various modifications and variations can be made to the method of determining a machine operation using virtual imaging. Other embodiments will be apparent to those skilled in the art from consideration of the specification and practice of the disclosed method of determining a machine operation using virtual imaging. It is intended that the specification and examples be considered as exemplary only, with a true scope being indicated by the following claims and their equivalents.

What is claimed is:

1. A method of determining a machine for operating at an actual site, comprising:

establishing a three-dimensional geographical model representing the actual site;

determining at least one operation characteristic relating to the operation of each of a set of machines in relation to the model;

predicting at least one performance characteristic for each machine based on the at least one operation characteristic and at least one respective characteristic of each machine;

comparing the predicted performance characteristics for each machine; and determining a target machine based on the comparison.

2. The method of claim 1, wherein the predicting of the at least one performance characteristic occurs before operating the target machine at the actual site.

3. The method of claim 1, further including measuring geographical information at the actual site, the geographical model including the measured geographical information.

4. The method of claim 3, wherein the measured geographical information includes at least one of elevation, contour, layout, material content, vegetation, water flow, drainage system, or temperature of the site.

5. The method of claim 4, wherein the measured geographical information includes material content of the site.

6. The method of claim 5, wherein the at least one operation characteristic includes work assignment information based on the measured material content of the site.

7. The method of claim 3, wherein the geographical information is measured using satellite photography.

8. The method of claim 1, wherein the at least one operation characteristic includes at least one of a location and work assignment information of each machine.

9. The method of claim 1, wherein the at least one machine characteristic includes at least one of weight, size, capacity, or speed of at least one of each machine or a component of each machine.

10. The method of claim 1, wherein the at least one performance characteristic includes at least one of timeframe, cost, health monitoring information, maintenance information, amount of material moved, and scheduling information.

11. The method of claim 1, wherein the at least one performance characteristic is predicted based on the at least one operation characteristic, the geographical information of the site, and at least one characteristic of each machine.

12. The method of claim 1, wherein the model includes information relating to a market price for at least one material located at the actual site.

13. The method of claim 12, wherein the at least one operation characteristic includes an amount of material excavated.

14. The method of claim 13, wherein the at least one performance characteristic includes operation costs for each machine and an estimated sales price for the amount of material excavated.

15. The method of claim 1, wherein the model includes information relating to one or more trees located at the actual site, and the at least one performance characteristic includes at least one of a time for cutting desired trees, an assigned route, and a location of the desired trees.

16. The method of claim 1, wherein the model includes information relating to work surface information and obstacle location information, the at least one operation characteristic including a location to load a payload, a haul route to be traveled, and a location to unload the payload, and the at least one performance characteristic includes at least one of timeframe, cost, health monitoring maintenance, scheduling information, efficiency, amount of material moved, and maintenance information.

17. The method of claim 1, wherein each machine includes at least one of a truck, a highway truck, a haulage vehicle, a mining vehicle, a material handling vehicle, a dozer, a loader, a backhoe, a motor grader, a dump truck, a harvesting machine, a skidder, a feller, a forwarder, a drag line system, and a crane.

18. A system for managing a machine at a site, comprising:

a controller, the controller including a user interface configured to display a three-dimensional geographical model representing a plurality of remote sites, the controller being configured to:

receive input identifying one of the remote sites;

determine an operation of the machine in relation to the model at the selected site;

determine at least one operation characteristic relating to the operation of the machine;

predict at least one performance characteristic of the machine based on the at least one operation characteristic and at least one characteristic of the machine; and receive input identifying a second remote site;

determine at least one operation characteristic relating to the operation of a second machine at the second remote site;

predict at least one performance characteristic of the second machine based on the at least one operation characteristic and at least one characteristic of the second machine; and compare the predicted performance characteristics of the first and second machines.

19. The system of claim 18, wherein the controller is further configured to transmit information relating to the determined operation to the machine at the selected site.

20. The system of claim 18, wherein the controller is further configured to determine the at least one performance characteristic before the operation of the machine at the selected site.

21. The system of claim 18, wherein the first and second machines are substantially similar.

22. The system of claim 18, wherein:

the selected site is a first site; and the controller is further configured to determine the machine based on a plurality of machines operating at a second site.

23. The system of claim 22, wherein the operation includes determining a route for the machine from the second site to the first site.

24. A method of planning an operation of a machine at an actual site, comprising:

establishing a three-dimensional geographical model representing the actual site;

determining a sales price for at least one material located at the actual site;

determining the machine;

determining at least one operation characteristic relating to the operation of the machine in relation to the model, the at least one operation characteristic including an amount of material excavated; and predicting at least one performance characteristic for the machine based on the at least one operation characteristic and at least one characteristic of the machine, the at least one performance characteristic including an estimated profit associated with the machine;

wherein the estimated profit is determined based on an operation cost for the machine and an estimated sales price for the amount of material excavated.

25. The method of claim 24, further including:

predicting at least one performance characteristic for at least a second machine based on an at least one operation characteristic relating to the operation of the second machine in relation to the model and at least one characteristic of the second machine;

comparing the predicted performance characteristics for each machine; and determining a target machine based on the comparison.

26. The method of claim 24, wherein the sales price for the at least one material is determined using a market price.

27. The method of claim 24, wherein the determining of the machine includes selecting the machine by user input.

* * * * *